United States Patent [19]

Nakata et al.

[11] 4,327,646

[45] May 4, 1982

[54] STABILIZING DEVICE FOR A CARRIAGE TRAVELLING ALONG AN AERIAL TRANSPORTING WAY

[75] Inventors: Sinji Nakata; Yutaka Nishimura, both of Yokohama; Susumu Ueki, Tokyo, all of Japan

[73] Assignee: Nissan Motor Company, Limited, Tokyo, Japan

[21] Appl. No.: 110,480

[22] Filed: Jan. 8, 1980

[30] Foreign Application Priority Data

Feb. 5, 1979 [JP] Japan ..... 54-12484

[51] Int. Cl.[3] ..... B61B 11/00

[52] U.S. Cl. ..... 104/89; 104/93; 104/112; 104/242; 105/199 A; 105/329 S

[58] Field of Search ..... 105/4 R, 4 A, 168, 199 A, 105/148, 149, 150, 329 S; 104/172 BT, 173 R, 173 ST, 93, 106, 112, 142, 145, 89, 242

[56] References Cited

U.S. PATENT DOCUMENTS

| | | | |
|---|---|---|---|
| 1,789,872 | 1/1931 | Kruckenberg et al. | 104/93 |
| 3,138,114 | 6/1964 | Knippel | 104/93 |
| 3,429,278 | 2/1969 | Gonzales | 104/93 |
| 3,728,969 | 4/1973 | Goforth et al. | 104/173 R |
| 4,092,930 | 6/1978 | Takemura et al. | 104/245 |

FOREIGN PATENT DOCUMENTS

| | | |
|---|---|---|
| 243851 | 12/1965 | Austria . |
| 1047811 | 12/1958 | Fed. Rep. of Germany . |
| 1273953 | 9/1960 | France . |

*Primary Examiner*—Richard A. Bertsch
*Attorney, Agent, or Firm*—Lane, Aitken, Kice & Kananen

[57] ABSTRACT

In an aerial transport system in which a carriage approaches a station or other fixed parts of the system, a device for stabilizing the carriage as it approaches the station or the other parts, comprising a pair of outward-facing bumping elements on the carriage, and a pair of bars in a V-shape, open towards the direction of approach of the carriage, in between which the bumping elements enter and are restricted as the carriage approaches the station and the other parts. The bars are supported so that they can be moved apart by the impact of the bumping elements, against a resilient restoring force.

19 Claims, 7 Drawing Figures

STABILIZING DEVICE FOR A CARRIAGE TRAVELLING ALONG AN AERIAL TRANSPORTING WAY

BACKGROUND OF THE INVENTION

The present invention relates to a stabilizing device for stabilizing a vehicle or carriage of an aerial tramway or cableway system. More specifically, the invention relates to an improvement in and for a stabilizing device for arresting rolling and/or pitching of the vehicle or carriage.

For simplifying the following descriptions, we mean the word "carriage" to include not only the carriage per se but also the vehicle, and the word "cableway" to include not only a cableway but also a tramway.

As will be well-known, there have been various aerial cableway systems for transporting passengers and/or articles contained within the carriage or carriages which travel along the cableway. Such cableway systems have been used for long mountain ascents and to cross canyons and rivers. Cableway systems are also used in factories as sections of automatic manufacturing systems. A cableway system generally comprises a cable suspended by two or more stationary towers and defining the cableway and one or more carriages travelling along the cableway. The carriage is provided with an electric driving means driven by electric power supplied through electric power collecting means.

Generally, the carriage travels along the cableway from one station to another station. Upon travelling the carriage is apt to sway in the rolling direction and/or pitching direction. Such swaying can, for example, cause the carriage to collide with parts of the station or the stationary tower, and can cause damage and injury.

A stabilizing device has comprised two bars, fixed to the station, formed in a substantially V-shaped or cross-sectional trumpet-shape with the opening of the V-shape or trumpet-shape facing the carriage as it approaches thereto, and further has comprised a buffer member fixed to the carriage, usually under it, which enters between the bars of the V-shape as the carriage comes thereinto. If the carriage is swinging as it comes into the station, therefore, by the bumping of the buffer member against the bars, this swinging is restrained.

In practice this system is only able to control mild swinging of the carriage, and it is necessary to slow down the carriage before it enters the station, in order to keep the forces exerted on the bars within a level which their fixing can stand, and which will not damage the buffer member or the carriage. In addition, this system is not adapted to restrain yaw movments of the carriage.

Further, in the conventional stabilizing device, there are required substantially heavy buffer members which cause increased weight of the carriage. Particularly, when several carriages are joined to travel together, the buffer members provided on respective carriages cause substantially heavy weight to be suspended on the supporting cable. This may result in substantially higher cost of the aerial transport system.

SUMMARY OF THE INVENTION

Therefore, it is an object of the present invention to provide an improved stabilizing device for efficiently reducing the swaying of a carriage of an aerial transport system as it enters a station or approaches other fixed parts of the system.

Another object of the invention is to provide a stabilizing device which can effectively damp rolling motion of the carriage as it enters a station or the other parts.

A further object of the invention is to provide such a stabilizing device which damps both rolling and pitching motions. A still further object of the invention is to provide efficient absorbing means for the shock of collision of the carriage and guide bars caused by rolling motion of the carriage so as to absorb the force of rolling motion.

A still further object of the invention is to provide a guide rail extending frontwardly in alignment to the center line of a passage defined by the pair of guide bars.

According to the present invention this and other objects are accomplished by, in a transport system in which a hanging carriage approaches a station, a device for stabilizing the carriage as it approaches the station or the other parts of an aerial tramway or cableway, comprising: a pair of bumping elements on the carriage, facing generally outwards away from one another; and a pair of bars, which together define an approximately horizontal V-shape or cross-sectional trumpet-shape opening towards the direction of approach of the carriage thereto, mounted on the station or stationary tower in such a manner that they can be moved apart against resilient restoring force; wherein, as the carriage approaches the stabilizing device the pair of bumping elements of the carriage enter the opening of the V-shape of the bars and engage with the bars if the carriage moves about its roll axis by an amount which progressively diminishes as the carriage goes forward.

Further, according to a more particular feature of the present invention, this and other objects may be accomplished by, in an aerial transporting system in which a hanging carriage approaches a station, a system for roll-pitch-stabilizing the carriage as it approaches the station, comprising: a pair of outward bumping elements on the carriage, facing generally outwards away from one another; a pair of inward bumping elements on the carriage, facing generally inwards towards one another; a pair of downward bumping elements on the carriage, facing generally downwards, and spaced along an axis in the same vertical plane as the general direction of motion of carriage; a pair of angled bars; mounted to the station in such a manner that they can be moved apart against resilient restoring force, each comprising a first straight portion and a second portion at an angle to the first straight portion and a second portion at an angle to the first straight portion, the ends of the first straight portion and the second portion being joined, the two second portions of the two bars together defining an approximately horizontal V-shape opening towards the direction of approach of the carriage to the station, and the two first straight portions extending from the narrow end of the V-shape away from the direction of approach of the carriage in parallel side by side at a distance apart great enough for the pair of outward bumping elements to enter between them; and a guide bar, fixedly mounted to the station and extending from its end located at the coterminous ends of the first straight portions away from the direction of approach of the carriage to the station, in that direction; wherein, as the carriage approaches the station:

first: the pair of outward bumping elements enter the opening of the V-shape of the angled bars and engage with the second portions thereof if the carriage moves about its roll axis by an amount which progressively diminishes as the carriage approaches the station, second: the pair of outward bumping elements enter between the first straight portions of the angled bars and engage with them if the carriage moves substantially about its roll axis, third: the pair of inward bumping elements move so that the guide bar passes between them, so that it engages them if the carriage moves substantially about its roll axis, fourth: the pair of downward bumping elements become located somewhat over the straight bar, so that they engage it if the carriage moves substantially about its pitch axis.

BRIEF DESCRIPTION OF THE DRAWINGS

The present invention will become more fully understood from the detailed description given hereinbelow, and from the accompanying description of several preferred embodiments of the present invention, which, however, are not to be taken as limitative of the present invention in any way, but are for the purposes of elucidation and explanation only. In the drawings.

DESCRIPTION OF THE PREFERRED EMBODIMENT

Figure 1:
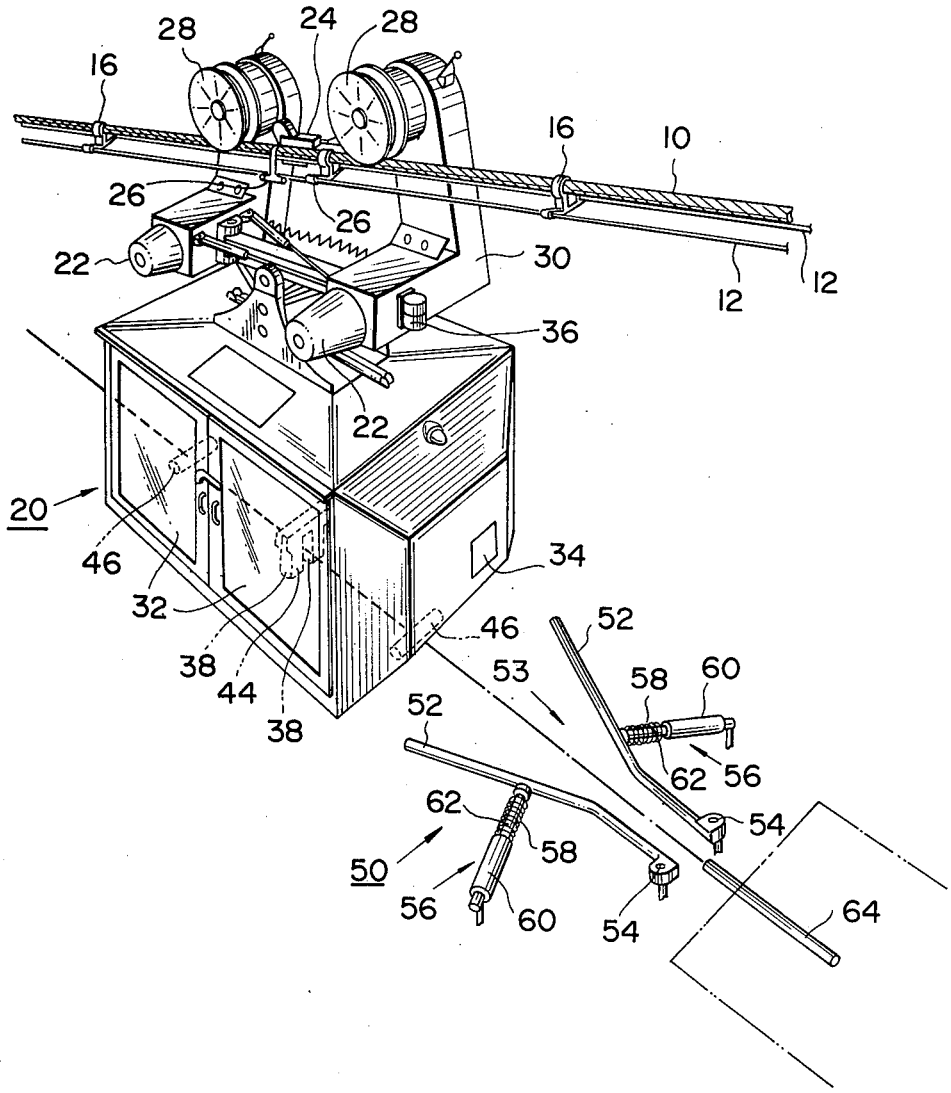
FIG. 1 is a perspective view of an aerial cableway system having a roll-pitch-stabilizer according to a preferred embodiment the present invention.

Referring now to the drawings, particularly to FIG. 1, there is illustrated a typical aerial cableway system. The cableway generally comprises a supporting cable 10 which is stretched between two or more stationary towers (not shown) and defines a cableway, and one or more carriages 20 travelling along the cableway. The carriage 20, shown in FIG. 1, is a type of self-propelling carriage which has electric driving means 22 such as electric motors. The driving means 22 are driven by electric power collected by an electric current collecting unit 24 which has a pair of current collecting shoes 26 slidably contacted to a pair of electric current-carrying cables. The current-carrying cables 12 are suspended from the supporting cable 10 by means of a plurality of brackets 16, in parallel relationship with respect to one another and with respect to the supporting cable 10.

The carriage 20 has a pair of wheels 28 engaging to the supporting cable 10 and driven by the driving means 22. The carriage 20 is suspended from the wheels 28 by suspending members 30. Each suspension member 30 is of hollow rectangular-shape in which power transmission means (not shown) connecting the driving means 22 and the wheels 28 are provided. Further, the carriage 20 has doors 32, a rescue hatch 34, and a speed control sensor 36. Though it is not clearly shown in the drawings, the carriage 20 and/or the suspending members 30 are suspended so as to be able to move in the roll and pitch modes.

In FIG. 1, there is also illustrated a stabilizing device 50 in accordance with a preferred embodiment of the present invention. The stabilizing devide 50 comprises a pair of guide bars 52, arresting members 56 and a guide rail 64. At their longitudinal intermediate portions, the guide bars 52 are bent outwardly from one another to define a cross-sectionally trumpet-shaped passage 53 opposed to the running direction of the carriage. In other words, the distance between the guide bars 52 is progressively wider in the direction opposed to the running direction of the carriage.

Respective guide bars 52 are rotatably pivoted at axes 54. Each arresting member 56 comprises a helical compression spring 58 and a shock absorber 60. The spring 58 is wound around a rod 62 one end of which is pivoted at the guide bars 52 and the other end of which is connected with the shock absorber 60. The spring 58 acts as a return spring for the rod 62 against force of rolling motion of the carriage.

It should be noted that, in this embodiment, although the shock absorber 60 is fixedly secured on a axis 63, it may alternatively be rotatable about the axis 63. But, practically, rolling of the carriage is expected not to be through so side a distance as to require pivoting of the shock absorber about the axis 63.

Figure 2:
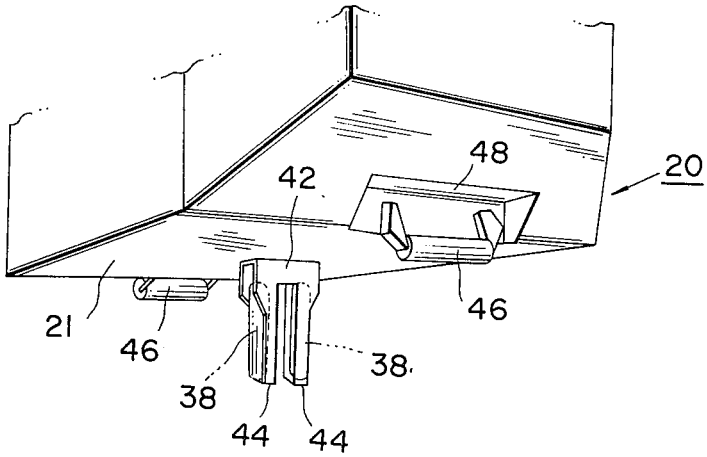
FIG. 2 is a perspective bottom view of the carriage of FIG. 1.
Figures 3, 4:
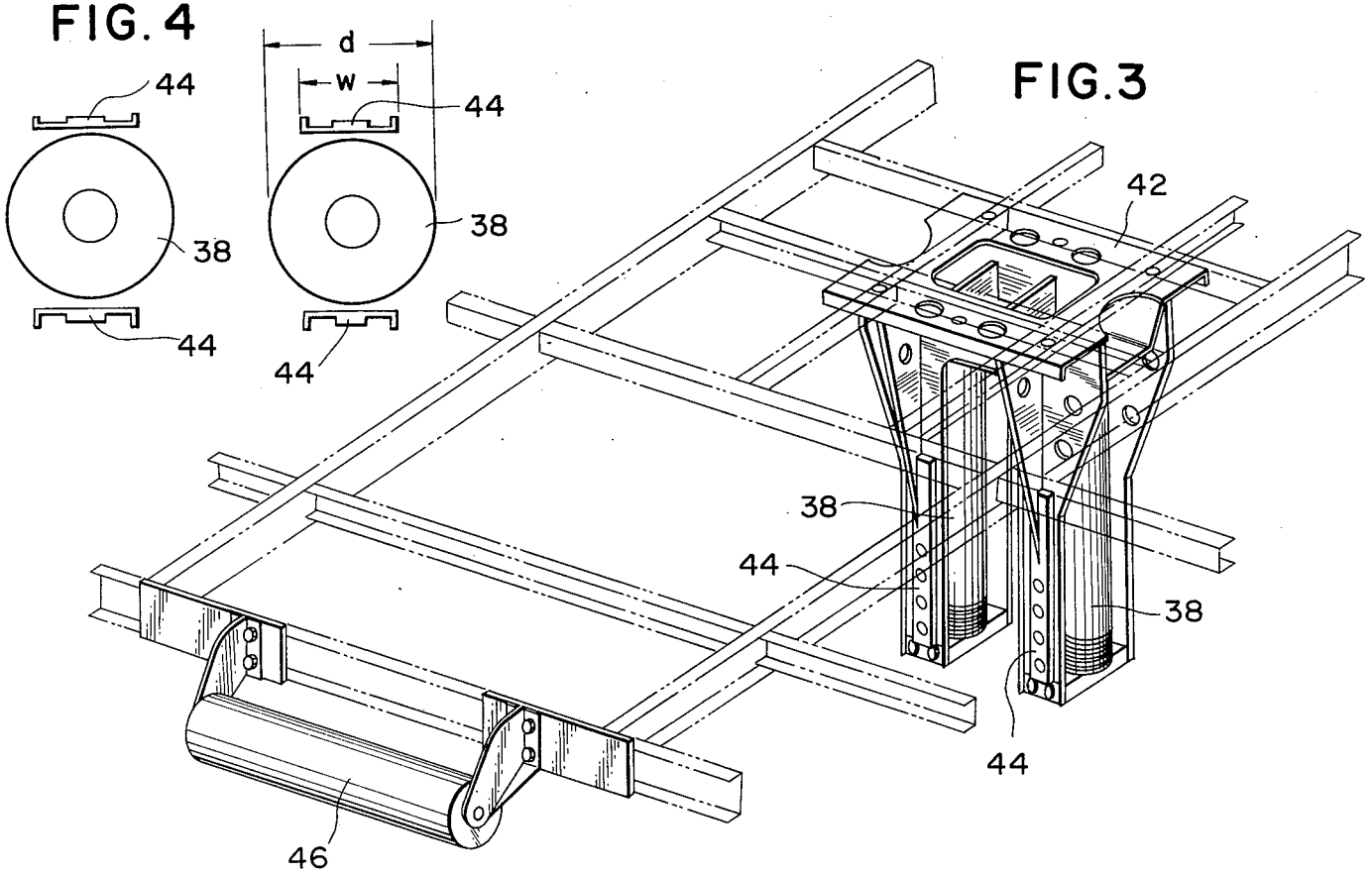
FIG. 3 is an enlarged perspective illustration of part of the arrangements on the bottom of the carriage of FIG. 1, seen through the carriage as though it were cut away.
FIG. 4 is a section through the vertical rollers of FIG. 3, taken perpendicular to their axes at their lower portions.

As shown in FIGS. 2 and 3, on the bottom 21 of the carriage 20 are provided a pair of vertical rollers 38 and a pair of horizontal rollers 46. The vertical rollers 38 respectively receive vertical axes 40, both ends of which are rotatably secured on the upper and lower portions of legs 44 of the bracket 42. The bracket, as clearly shown in FIG. 3, is formed in a substantially gate-shaped configuration having a lower end opened recess between pairs of legs 44. The bracket 42 is mounted on the outer surface of the bottom 21 of the carriage 20 and protruded downwardly therefrom. As shown in FIG. 4, the width w of the leg 44 is narrower than the diameter d of the roller 38, and thus the roller 38 protrudes sidewards past both the sides of the legs 44.

The horizontal rollers 46 are mounted on the outer surface of the bottom 21 of the carriage 20 and protrude downwardly therefrom. In the preferred construction, the carriage 20 is provided with recesses 48 from which the rollers 46 protrude.

Figure 5:
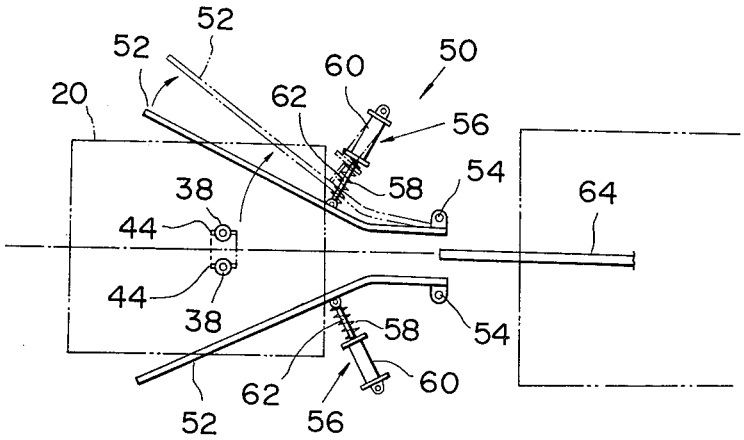
FIG. 5 is a view from underneath of the stabilizer system, in a rather schematic illustration.

Now, we will explain the function of the above-mentioned stabilizing device 50 according to the preferred embodiment of the present invention. As shown in FIG. 5, when the carriage 20 enters into the passage 53 defined by the guide bars 52 while rolling, one of the vertical rollers 38 contacts the inner side of one of the guide bars 52, and forces the guide bar 52 outwards. When the guide bar 52 is subject to this force, it rotates about the axis 54 against the resilient force of the spring 58. This results in contraction of the shock absorber 60 to absorb the force. When the rolling of the carriage 20 exceeds the range in which the force of the rolling motion can be absorbed by one arresting motion of the shock-absorber 60, the carriage 20, subsequently, rotates about its roll-axis in the opposite direction to contact the other roller 38 onto the inner side of the other guide bar 52 and force it outwards. Then the shock absorber 60 connected with this guide bar 52 acts to absorb this force. By repeating arresting operation of both the arresting members 56, the rolling of the carriage is stabilized.

Thereafter, the carriage passes through the passage 53. The vertical rollers, then, engage with the guide rail 64 extended from the front end of the stabilizing means 50. As shown in FIG. 5, the rollers 38 sandwich the guide rail 64 and rotate therealong. Thereby, the carriage is completely prevented from rolling.

Figure 6:
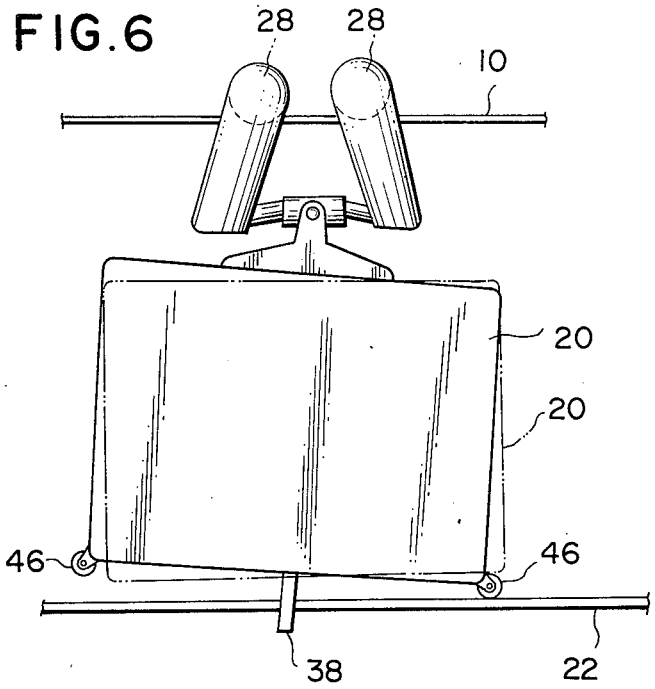
FIG. 6 is a schematic side view for illustration of the operation of the stabilizer system.

Then, the horizontal rollers 46 contact and rotate on the upper surface of the guide rail 64 so as to prevent the carriage from pitching. This function of the horizontal rollers 46 and the guide rail 64 will be apparent from FIG. 6.

Figure 7:
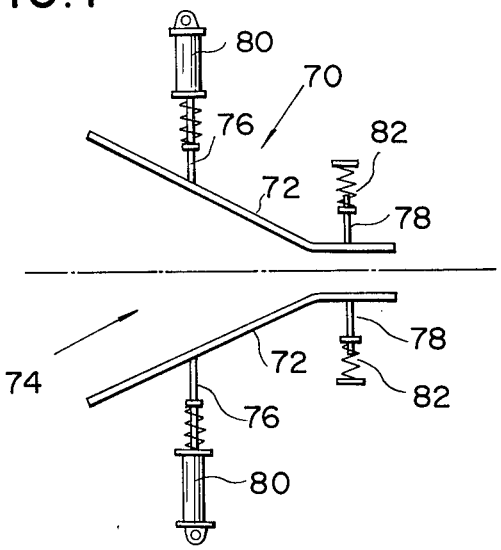
FIG. 7 is a plan view of part of stabilizing device according to a second embodiment of the present invention.

In FIG. 7, there is shown another embodiment of the stabilizing means 70 according to the present invention. A pair of guide bars 72 defines a cross-sectionally trumpet-shaped passageway 74 parallel to the cableway. The guide bars 72 are supported by pairs of rods 76 and 78. The rod 76 is connected with a shock absorber 80. Around the rods 76 and 78 there are wound helical compression springs 82 which act as return springs. The guide bars 72 are movable to and fro with respect to the cableway with two degrees of freedom.

If the carriage runs into the passageway 74 while rolling, the vertical roller contacts one or the other of the guide bars and forces it outwards. The rod 76 is thereby forced outwards and subject the shock absorber 80 to the force. The shock absorber 80 then acts to absorb the force. By alterntively or repeatedly contacting the vertical rollers onto the guide bars, the carriage is gradually arrested or stabilized.

It should be noted that the stabilizing device may be constructed and embodied otherwise, according to the present invention. For example, it would be possible to pivot the bars at their ends nearest the wide point of the V-shape. However, in the preferred construction, the guide bars are pivoted as in the first embodiment. Employing such a construction, as the carriage advances, the force for arresting rolling is increased, since the distance between the pivots and portions subject to the force of the rolling is progressively shortened.

Further, otherpossible modifications to any particular embodiment of the present invention are possible; for instance, other types of bumping elements could be used as mounted on the carriage, rather than rollers. The first embodiment shown uses the vertical rollers 38 for two functions, both to engage the guide bars 52, and the guide rail 64, by employing both their inside and their outside portions; but this is not essential. Therefore, although the present invention has been shown and described in terms of several preferred embodiments, it should not be considered as limited to these, however, or mere and simple generalizations, or other detailed embodiments. Yet further variations to any particular embodiment could be made without departing from the scope of the present invention, which it is therefore desired should be delimited and defined not by any of the perhaps purely fortuitous details of the shown embodiments, or of the drawings, but solely by the accompanying claims.

What is claimed is:

1. A stabilizing device for an aerial carriage travelling along an aerial cableway comprising:

a pair of bumping elements vertically protruding from the bottom of said carriage, said bumping elements being arranged in alignment transverse with respect to the longitudinal axis of said carriage and apart from each other to define therebetween a space;

a pair of guide bars defining an approximately horizontal V-shape opening towards the direction of approach of the carriage, said guide bars being collidable with said bumping elements and movable from initial positions to other positions farther away from each other upon collision with said bumping elements; and means for biasing said guide bars to said initial positions thereof, which biasing means damp the colliding force applied by the collision of the bumping element with said guide bar.

2. A stabilizing device for an aerial carriage travelling along an aerial cableway comprising:

a pair of bumping elements on the carriage, facing generally outwards away from one another;

a pair of rigid guide bars defining an approximately horizontal V-shaped passageway for said carriage through which said bumping elements pass upon approach to a station, each of said guide bars being movable between an initial position relative to the other guide bar and a moved position moved away from the other guide bar;

means for biasing each of said guide bars to said initial position with a resilient force against the impact of collision of said bumping elements and said guide bars; and means, incorporated in said biasing means, for absorbing the force of impact to stabilize the rolling of the carriage.

3. A stabilizing device for an aerial carriage travelling along an aerial cableway comprising:

a pair of bumping elements protruding vertically from the bottom of the carriage in parallel relationship with respect to one another, said bumping elements being located in transverse alignment with respect to the longitudinal axis of the carriage and in spaced apart relationship to define therebetween a substantially narrow space;

a pair of angled rigid guide bars respectively pivoted about a stationary member at the end of the guide bar remote from an approaching carriage, said pivoted ends of the guide bars being spaced for permitting said bumping elements to pass therethrough and adapted for restricting the lateral motion of the bumping elements, said guide bars being movable about said stationary member between an initial position in which said guide bars define an approximately horizontal V-shaped passageway for permitting said bumping elements to pass therethrough, and a moved position in which one of said guide bars is moved from said initial position away from the other guide bar when the bumping element adjacent said one guide bar collides therewith;

means for biasing said guide bars to said initial position against the force applied to one of said guide bars when the adjacent bumping element collides therewith, said biasing means acting to restore said one guide bar to its initial position against the colliding force; and means, incorporated in said biasing means, for absorbing a force which causes rolling of the carriage.

4. A system according to claim 1, 2 or 3, wherein the guide bars are prolonged away from the direction of approach of the carriage from the narrow end of the V-shape by parallel straight portions arranged side by side at a distance apart great enough for the pair of bumping elements to enter between them.

5. A system according to claim 1, 2 or 3, wherein the bumping elements are a pair of rollers pivoted to the carriage about vertical axes side by side.

6. A system according to claim 4, wherein the bumping elements are a pair of rollers pivoted to the carriage about vertical axes side by side.

7. A system according to claim 6, wherein the ends of the straight portions remote from the V-shape are pivoted about vertical axes side by side.

8. A system according to claim 7, wherein for each bar two spring and shock absorber assemblies are provided, one joined to it at V-shape, and the other joined to it at the straight portion remote from the V-shape.

9. A system according to claim 1, wherein the bars are provided with a spring and shock absorber assembly.

10. A system according to claim 2 or 3, wherein each bar is provided with by two separate spring and shock absorber assemblies, and is movable with respect to the other bar with two degrees of freedom.

11. In a transport system having a hanging carriage which travels along an aerial tramway or cableway, a system for roll-pitch-stabilizing the carriage as it approaches thereto, comprising:

a pair of outward bumping elements on the carriage, facing generally outwards away from one another;

a pair of inward bumping elements on the carriage, facing generally inwards towards one another;

a pair of downward bumping elements on the carriage, facing generally downwards, and spaced along an axis in the same vertical plane as the general direction of motion of the carriage;

a pair of angled rigid bars, mounted to stationary members in such a manner that they can be moved apart against a resilient restoring force, each of said bars having a first straight portion and a second portion at an angle to the first straight portion, the ends of the first straight portion and the second portion being joined, the two second portions of the two bars together defining an approximately horizontal V-shape opening towards the direction of approach of the carriage to said stabilizing system, and the two first straight portions extending from the narrow end of the V-shape away from the direction of approach of the carriage in parallel side by side relationship at a distance apart great enough for the pair of outward bumping elements to enter between them; and a stationary bar extending from the ends of the first straight portions which are away from the direction of approach of the carriage thereto to a point removed from the ends of the first straight portions in the direction away from the direction of approach of the carriage.

12. A system according to claim 11, wherein the outward bumping elements and the inward bumping elements are respectively the outer parts and the inner parts of two roll-bumping rollers which are mounted about parallel vertical axes side by side to the carriage, and the downward bumping elements are two pitch-bumping rollers mounted about parallel axes to the carriage parallel to its pitch axis.

13. A system according to either claim 11 or 12, wherein each bar is provided with two separate spring and shock absorber assemblies, and is movable with respect to the other bar with two degrees of freedom.

14. A system according to either claim 11 or 12, wherein the ends of the first straight portions of the bars remote from the V-shape are pivoted to the stationary members about vertical axes side by side.

15. A system according to claim 14, wherein each bar is further provided with a spring and shock absorber assembly.

16. A method for stabilizing an aerial carriage travelling along an aerial cableway comprising:

resiliently limiting the lateral motion of the carriage about a rolling axis thereof, and gradually reducing the lateral spacing in which the lateral motion of said carriage is being limited;

absorbing the force causing the lateral motion of the carriage and stabilizing the rolling motion of the carriage;

guiding the carriage along said cableway so that it may not move in the lateral direction with respect to the rolling axis thereof; and restricting pitching motion of the carriage about the pitching axis thereof.

17. A method as set forth in claim 16, wherein limiting the lateral motion of the carriage is performed by guiding the carriage by a gradually narrowed passageway which is defined by a pair of guide bars respectively angled away from each other at the end of the passageway adjacent the approach of the carriage.

18. A method as set forth in claim 3 or 16, wherein absorbing the lateral motion force of the carriage is carried out by a spring-and-absorber assembly which serves for resiliently limiting the lateral motion of the carriage and absorbing the force causing the lateral motion of the carriage.

19. A method as set forth in claim 18, wherein guiding the carriage along said cableway and restricting the pitching motion of the carriage is carried out by a common guide member extending along the cableway.

* * * * *